US009669407B2

(12) United States Patent
Kojima et al.

(10) Patent No.: US 9,669,407 B2
(45) Date of Patent: Jun. 6, 2017

(54) MICROCHIP

(75) Inventors: Kensuke Kojima, Kanagawa (JP); Yuji Segawa, Tokyo (JP); Hidetoshi Watanabe, Chiba (JP); Yoshiaki Kato, Gunma (JP); Toshio Watanabe, Kanagawa (JP)

(73) Assignee: Sony Corporation, Tokyo (JP)

( * ) Notice: Subject to any disclaimer, the term of this patent is extended or adjusted under 35 U.S.C. 154(b) by 344 days.

(21) Appl. No.: 13/292,699

(22) Filed: Nov. 9, 2011

(65) Prior Publication Data

US 2012/0121484 A1 May 17, 2012

(30) Foreign Application Priority Data

Nov. 12, 2010 (JP) ..... 2010-254305
Dec. 17, 2010 (JP) ..... 2010-281881

(51) Int. Cl.
*B01L 3/00* (2006.01)
*B01L 9/00* (2006.01)

(52) U.S. Cl.
CPC ..... *B01L 3/502715* (2013.01); *B01L 9/527* (2013.01); *B01L 2200/025* (2013.01); *B01L 2200/027* (2013.01); *B01L 2200/04* (2013.01); *B01L 2200/0684* (2013.01); *B01L 2200/0689* (2013.01); *B01L 2200/18* (2013.01); *B01L 2300/043* (2013.01); *B01L 2300/044* (2013.01); *B01L 2300/0609* (2013.01); *B01L 2300/0672* (2013.01); *B01L 2300/0816* (2013.01); *B01L 2300/123* (2013.01); *B01L 2400/049* (2013.01)

(58) Field of Classification Search
CPC ..... B01L 3/502715; B01L 2200/18; B01L 2200/04; B01L 2200/0684; B01L 2200/0689; B01L 2300/043; B01L 2300/044; B01L 2300/0609; B01L 2300/0672; B01L 2300/0816; B01L 2300/123; B01L 2400/049; B01L 9/527; B01L 2200/027
USPC ..... 436/180; 422/501–503, 512, 570
See application file for complete search history.

(56) References Cited

U.S. PATENT DOCUMENTS

2002/0084215 A1* 7/2002 Coville et al. ..... 210/321.6
2005/0072671 A1* 4/2005 Rocklin ..... G01N 30/34 204/409

FOREIGN PATENT DOCUMENTS

JP 2004-219199 8/2004
JP 2009-284769 10/2009

* cited by examiner

*Primary Examiner* — Shogo Sasaki
(74) *Attorney, Agent, or Firm* — Chip Law Group

(57) ABSTRACT

Disclosed herein is a microchip that allows a sample to be introduced into a region easily and accurately, and which makes it possible to obtain high analysis accuracy. The microchip includes an airtight region into which a solution is externally introduced; and positioning means for positioning a channel for injecting the solution into the region by penetrating a substrate layer forming the region with respect to a puncture part of the region.

8 Claims, 13 Drawing Sheets

MICROCHIP

CROSS REFERENCES TO RELATED APPLICATIONS

The present application claims priority to Japanese Patent Application No. 2010-254305 filed on Nov. 12, 2010 and Japanese Patent Application No. 2010-281881 filed on Dec. 17, 2010 and, the disclosures of which are incorporated herein by reference.

BACKGROUND

The present disclosure relates to a microchip, and particularly to a microchip for introducing a substance into a region disposed on a substrate so that chemical analysis or biological analysis is performed.

Recently, microchips having a region such as a well, a flow path, or the like for performing chemical analysis or biological analysis on a substrate such as a substrate made of silicon, a substrate made of glass, or the like have been developed by applying microfabrication technology in a semiconductor industry (see Japanese Patent Laid-Open No. 2004-219199). These microchips have started to be used in for example an electrochemical detector for liquid chromatography or a small electrochemical sensor in an actual place of medical treatment.

An analyzing system using such a microchip is referred to as μ-TAS (micro-Total Analysis System), a lab on a chip, a biochip, or the like, and is drawing attention as technology that makes it possible to achieve higher speed of analysis, higher efficiency of analysis, or a higher degree of integration as well as the miniaturization of an analyzing device and the like.

μ-TAS enables analysis with a small amount of a sample and the disposable use (single use) of microchips, and is thus expected to be applied to biological analysis dealing with very small amounts of valuable samples and a large number of analytes in particular.

An example of application of μ-TAS is an optical detecting device that introduces a substance into a plurality of regions arranged on a microchip and which optically detects the substance. Such optical detecting devices include an electrophoresis device that separates a plurality of substances from each other in a flow path on the microchip by electrophoresis and which optically detects each of the separated substances, a reaction device (for example a real-time PCR device) that allows reaction between a plurality of substances to progress within a well on the microchip and which optically detects a resulting substance, and the like.

In μ-TAS, because of a very small amount of a sample and minute regions such as wells, flow paths, or the like, it is difficult to introduce the sample into the regions accurately, the introduction of the sample may be obstructed by an air present within the regions, and the introduction may take time. In addition, air bubbles may occur within the regions at the time of the introduction of the sample. As a result, the amount of the sample introduced into each flow path, each well, or the like varies, thus decreasing analysis accuracy and decreasing analysis efficiency. In addition, when the sample is heated as in PCR, air bubbles remaining within the regions expand, and thus hamper reaction and decrease analysis accuracy.

In order to facilitate the introduction of a sample in μ-TAS, Japanese Patent Laid-Open No. 2009-284769, for example, discloses a "substrate equipped with at least a sample introducing part for introducing samples, a plurality of housing parts for housing the samples, and a plurality of air discharging parts connected to the respective storing parts, wherein at least two or more of the air discharging parts communicate with one open channel having one opened terminal." In this substrate, the air discharging parts are connected to the respective housing parts. Thereby, when a sample is introduced from the sample introducing part into the housing parts, an air present in the housing parts is discharged from the air discharging parts. Thus, the housing parts can be smoothly filled with the sample.

SUMMARY

As described above, in μ-TAS, because of a very small amount of a sample and minute regions such as wells, flow paths, or the like, it is difficult to introduce the sample into the regions accurately. It is accordingly desirable to provide a microchip that allows a sample to be introduced into the regions easily and accurately, and which makes it possible to obtain high analysis accuracy.

According to a mode of the present disclosure, there is provided a microchip including: an airtight region into which a solution is externally introduced; and a positioning section configured to position a channel for injecting the solution into the region by penetrating a substrate layer forming the region with respect to a puncture part of the region.

This microchip can further include: a main body including the region and the puncture part; and a frame body configured to retain the main body by two or more arms extended toward a center. In this case, the positioning section can be formed by making a positioning hole for inserting the channel into the puncture part in one of the arms, the one of the arms being extended over the puncture part. According to this constitution, when a sample liquid is introduced, the channel is inserted into the positioning hole provided in the arm of the frame body and made to puncture the main body. Thereby the puncture part can be punctured accurately.

Preferably, at least one or more of the arms of the frame body have flexibility, and retain the main body so as to bias the main body against a mounting surface for the microchip on a basis of the flexibility. In this case, the arm can be formed as a leaf spring.

In addition, the microchip may also include: a main body including the region and the puncture part; a first member configured to retain the main body; and a second member configured to retain the channel such that the channel is faced toward the puncture part. In this case, one end of the first member and one end of the second member can be coupled to each other by a hinge, and the channel retained by the second member can be positioned with respect to the puncture part of the main body retained by the first member in a state of the hinge being closed. According to this constitution, when a sample liquid is introduced, the hinge is closed with the main body retained in the first member and with the channel retained in the second member, whereby the puncture part can be punctured with the channel accurately.

According to another mode of the present disclosure, there is provided a frame body forming a microchip. The microchip includes: a main body including an airtight region into which a solution is externally introduced, and a puncture part of the region; and a frame body configured to retain the main body by two or more arms extended toward a center. In the microchip, a positioning section is formed by making a positioning hole for inserting a channel for injecting the solution into the region by penetrating a substrate layer forming the region into the puncture part in one of the arms, the one of the arms being extended over the puncture part.

According to a further mode of the present disclosure, there is provided a jig formed by coupling a first member and a second member forming a microchip to each other by a hinge at one end of the first member and one end of the second member. The microchip includes: a main body including an airtight region into which a solution is externally introduced, and a puncture part of the region; the first member configured to retain the main body; and the second member configured to retain a channel for injecting a solution into the region by penetrating a substrate layer forming the region such that the channel is faced toward the puncture part. In the microchip, one end of the first member and one end of the second member are coupled to each other by the hinge, and the channel retained by the second member is positioned with respect to the puncture part of the main body retained by the first member in a state of the hinge being closed.

According to a still further mode of the present disclosure, there is provided a microchip equipped with a container. The microchip equipped with the container includes: a microchip including an airtight region into which a solution is externally introduced; and a container for housing the microchip inside. In the microchip, a positioning hole for inserting a channel for injecting the solution into the region by penetrating a substrate layer forming the region into a puncture part of the housed microchip from an outside of the container is made in the container. According to this constitution, when a sample liquid is introduced, the channel is inserted into the positioning hole provided in the container, and the channel punctures the microchip. Thereby, the puncture part can be punctured accurately.

In these microchips, the substrate layer preferably has a self-sealing property due to elastic deformation, and an inside of the region is preferably under a negative pressure with respect to an atmospheric pressure.

According to a yet further mode of the present disclosure, there is provided a packing material for a microchip equipped with a container. The microchip equipped with the container includes a microchip including an airtight region into which a solution is externally introduced, and a container for housing the microchip inside. In the microchip, a positioning hole for inserting a channel for injecting the solution into the region by penetrating a substrate layer forming the region into a puncture part of the housed microchip from an outside of the container is made in the container. An inside of the region is under a negative pressure with respect to an atmospheric pressure; and the container housing the microchip is sealed under a reduced pressure.

The present disclosure provides a microchip that allows a sample to be introduced into a region easily and accurately, and which makes it possible to obtain high analysis accuracy.

Additional features and advantages are described herein, and will be apparent from the following Detailed Description and the figures.

DETAILED DESCRIPTION

Embodiments of the present application will be described below in detail with reference to the drawings.

Preferred embodiments of the present disclosure will hereinafter be described with reference to the drawings. It is to be noted that the embodiments to be described in the following represent an example of typical embodiments of the present disclosure, and that the scope of the present disclosure is not to be thereby construed narrowly. Incidentally, description will be made in the following order.

Figure 1A:
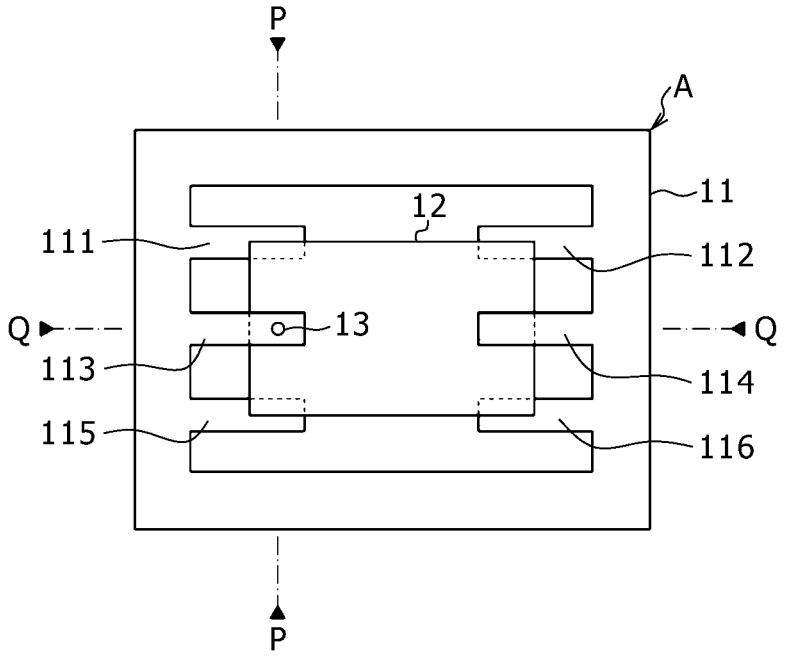
FIGS. 1A, 1B, and 1C are schematic diagrams of assistance in explaining the constitution of a microchip according to a first embodiment of the present disclosure, FIG. 1A being a top view, FIG. 1B being a sectional view corresponding to a section P-P of FIG. 1A, and FIG. 1C being a sectional view corresponding to a section Q-Q of FIG. 1A.
Figure 1B:
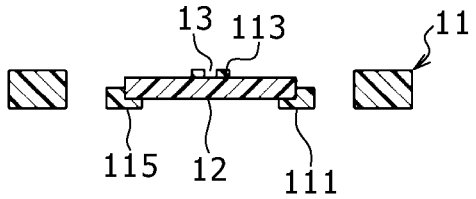
Figure 1C:
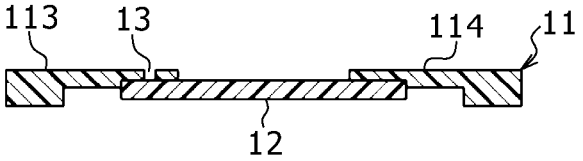

1. Microchip according to First Embodiment
2. Example of Modification of Microchip according to First Embodiment
3. Microchip according to Second Embodiment
4. Microchip according to Third Embodiment
5. Microchip according to Fourth Embodiment 6. Example of Modification of Microchip according to Fourth Embodiment 1. Microchip According to First Embodiment FIGS. 1A, 1B, and 1C are schematic diagrams of a microchip according to a first embodiment of the present disclosure. FIG. 1A is a top view. FIG. 1B is a sectional view corresponding to a section P-P of FIG. 1A. FIG. 1C is a sectional view corresponding to a section Q-Q of FIG. 1A.

The microchip indicated by a reference A in FIG. 1A includes a main body 12 having a region disposed therein into which region a substance is introduced and in which region chemical analysis or biological analysis of the substance is performed and a frame body 11 for retaining the main body 12. The frame body 11 retains the main body 12 by arms 111, 112, 113, 114, 115, and 116 disposed so as to extend toward a center. Of the arms, the arms 111, 112, 115, and 116 are in contact with the lower surface of the main body 12, and retain the main body 12 from below. In addition, the arms 113 and 114 are in contact with the upper surface of the main body 12, and retain the main body 12 from above. The main body 12 is thereby sandwiched between the lower arms 111, 112, 115, and 116 and the upper arms 113 and 114 and retained by the lower arms 111, 112, 115, and 116 and the upper arms 113 and 114. The main body 12 may be retained by these arms so as to be detachable from the frame body 11. In addition, the main body 12 and the frame body 11 may be bonded to each other by adhesion at the surfaces of the main body 12 and the frame body 11 which surfaces are in contact with each other, or may be bonded to each other by being formed integrally with each other.

A reference numeral 13 in FIGS. 1A to 1C denotes a positioning hole functioning, when a solution (hereinafter referred to also as a "sample liquid") is externally injected into the region disposed in the main body 12, to position a channel for injecting the sample liquid in an appropriate part (specifically a "puncture part 14" to be described later) of the main body 12. The positioning hole 13 is made in the arm 113 disposed so as to extend on the main body 12.

Figure 2A:
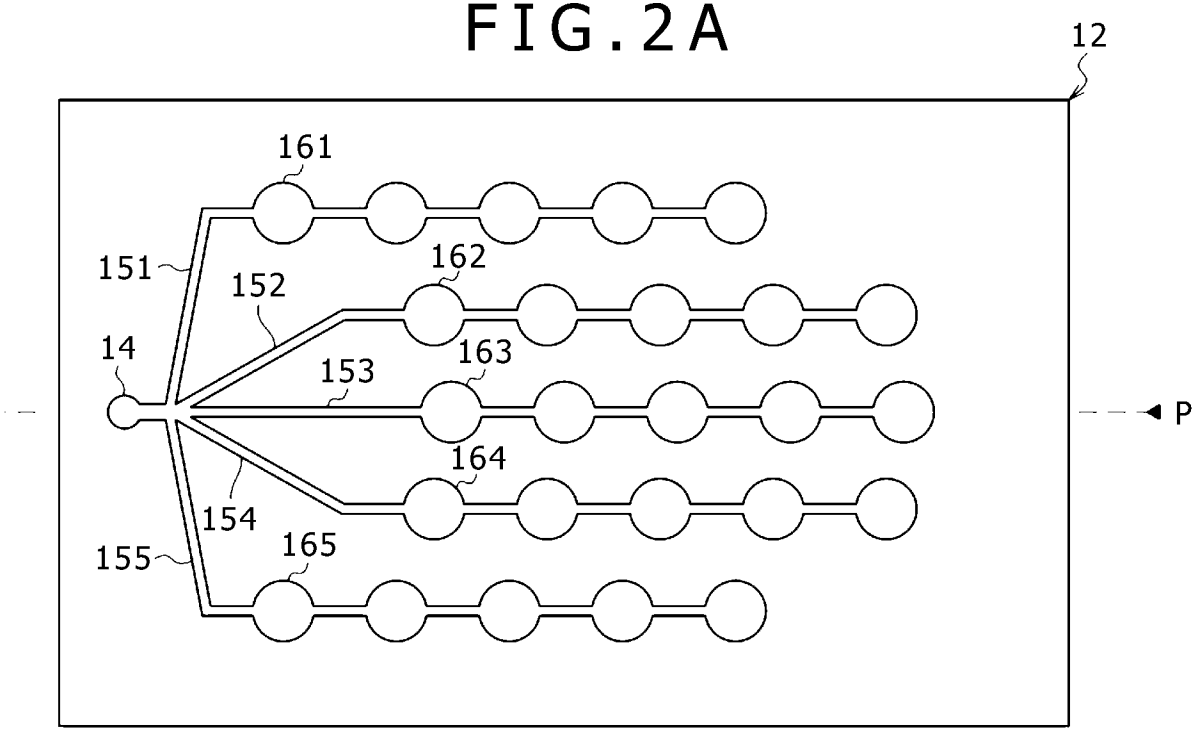
FIGS. 2A and 2B are schematic diagrams of assistance in explaining the constitution of a main body 12 of the microchip A, FIG. 2A being a top view, and FIG. 2B being a sectional view corresponding to a section P-P of FIG. 2A.
Figure 2B:
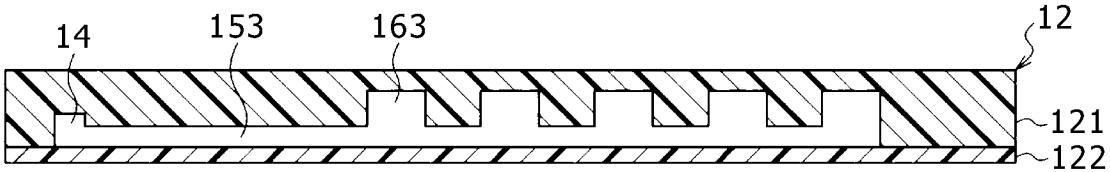

FIGS. 2A and 2B are schematic diagrams of the main body 12 of the microchip A. FIG. 2A is a top view. FIG. 2B is a sectional view corresponding to a section P-P of FIG. 2A.

The main body 12 has the following regions formed as airtight regions into which a sample liquid is externally introduced. First, a puncture part 14 is a region into which a sample liquid is externally injected by puncture. The positioning hole 13 described with reference to FIGS. 1A to 1C is made in the arm 113 so as to be located above this puncture part 14.

Next, wells 161, 162, 163, 164, and 165 are places of analysis of substances included in the sample liquid or reaction products of the substances. Further, flow paths 151, 152, 153, 154, and 155 are regions for sending the sample liquid injected into the puncture part 14 to the wells 161, 162, 163, 164, and 165, respectively.

The wells 161 are arranged as five wells, and the wells adjacent to each other are made to communicate with each other by the flow path 151. In addition, one of the wells 161 is connected to the puncture part 14 by the flow path 151. A constitution is thereby formed such that the sample liquid injected into the puncture part 14 and sent through the flow path 151 is introduced into the five wells 161 in order. This constitution is similarly formed by the wells 162 to 165 and the flow paths 152 to 155.

The flow path length of the flow path 151 to the well 161 into which the sample liquid is first introduced from the puncture part 14 and the flow path length of the flow path 152 to the well 162 into which the sample liquid is first introduced from the puncture part 14 are preferably equal to each other so that the sample liquid injected into the puncture part 14 simultaneously starts to be introduced into the wells 161 and the wells 162. The same is true for the flow path length of the flow path 153, 154, or 155 to the well 163, 164, or 165 into which the sample liquid is first introduced from the puncture part 14.

In addition, the wells 161 and the wells 162 are preferably arranged at equal intervals and thereby the total length of the flow path 151 and the total length of the flow path 152 are preferably equal to each other so that the sample liquid injected into the puncture part 14 simultaneously completes being introduced into the wells 161 and the wells 162. The same is true for the arrangement intervals of the wells 163 to 165 and the total lengths of the flow paths 153 to 155.

The microchip A is formed by laminating a substrate layer $a_2$ to a substrate layer $a_1$ in which the puncture part 14, the flow paths 151 to 155, and the wells 161 to 165 are formed. The substrate layer $a_1$ and the substrate layer $a_2$ of the microchip A are laminated to each other under a negative pressure with respect to an atmospheric pressure. Thereby inside parts of the respective regions of the puncture part 14, the flow paths 151 to 155, and the wells 161 to 165 are hermetically sealed so as to be under a negative pressure (for example 1/100 of the atmospheric pressure). Further, it is more desirable to laminate the substrate layer $a_1$ and the substrate layer $a_2$ to each other under vacuum, and hermetically seal the inside parts of the respective regions so that the inside parts of the respective regions form a vacuum.

Materials for the substrate layers $a_1$ and $a_2$ can be glass or various kinds of plastic (polypropylene, polycarbonate, cycloolefin polymers, and polydimethylsiloxane). Similar materials can also be used for the frame body 11. At least one of the substrate layers $a_1$ and $a_2$ is preferably formed of an elastic material. The elastic material includes a silicone base elastomer such as polydimethylsiloxane (PDMS) or the like as well as an acrylic base elastomer, a urethane base elastomer, a fluorine base elastomer, a styrene base elastomer, an epoxy base elastomer, natural rubber or the like. When at least one of the substrate layers $a_1$ and $a_2$ is formed of such an elastic material, a self-sealing property to be described next can be imparted to the microchip A.

When the substances introduced into the wells 161 to 165 are analyzed optically, a material having optical transparency, little autofluorescence, and a small optical error due to little wavelength dispersion is preferably selected as the material for the substrate layers $a_1$ and $a_2$.

The puncture part 14, the flow paths 151 to 155, and the wells 161 to 165 can be formed in the substrate layer $a_1$ by for example wet etching or dry etching of a substrate layer made of glass or nanoimprint, injection molding, or cutting of a substrate layer made of plastic. Each region may be formed in the substrate layer $a_2$, or a part of the regions may be formed in the substrate layer $a_1$ and the other parts may be formed in the substrate layer $a_2$. The substrate layers $a_1$ and $a_2$ can be laminated to each other by a publicly known method such for example as heat sealing, an adhesive, anodic bonding, boding using an adhesive sheet, plasma activated bonding, or ultrasonic bonding.

Figure 3A:
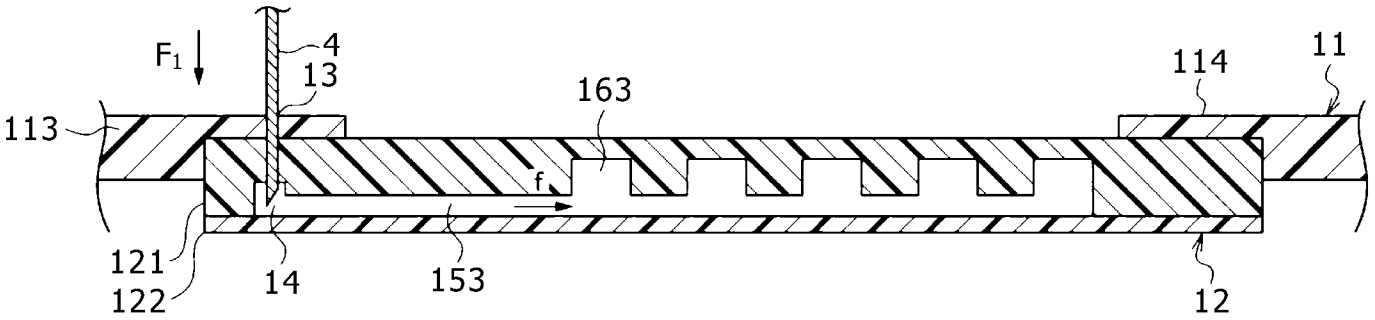
FIGS. 3A and 3B are schematic sectional views of assistance in explaining a method of introducing a sample liquid into the microchip.
Figure 3B:
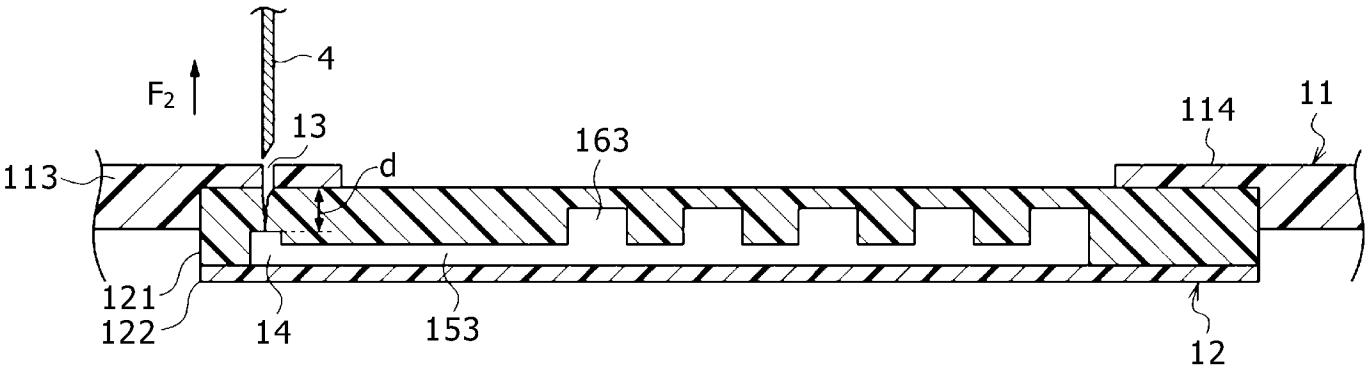

A method of introducing a sample liquid into the microchip A will next be described with reference to FIGS. 3A and 3B. FIGS. 3A and 3B are schematic sectional views of the microchip A, and correspond to the section Q-Q of FIG. 1A.

As shown in FIG. 3A, a sample liquid is introduced into the microchip A by making a channel 4 penetrate the substrate layer $a_1$ and injecting the sample liquid into the puncture part 14. An arrow $F_1$ in FIG. 3A indicates a direction of puncture of the channel 4. The puncture of the channel 4 is made such that the pointed part of the channel 4 pierces from the surface of the substrate layer $a_1$ through the substrate layer $a_1$ and reaches the inner space of the puncture part 14.

At this time, the channel 4 is inserted into the positioning hole 13 made in the arm 113 of the frame body 11 so as to be situated above the puncture part 14, and is made to puncture the substrate layer $a_1$. By thus aiming the channel 4 at the positioning hole 13 provided in advance so as to be situated above the puncture part 14, inserting the channel 4 into the positioning hole 13, and making the channel 4 puncture the substrate layer $a_1$, the channel 4 can be positioned with respect to the puncture part 14, and the pointed part of the channel 4 can surely reach the inner space of the puncture part 14.

The sample liquid externally injected into the puncture part 14 is sent through the flow paths 151 to 155 (see an arrow f in FIG. 3A), and then introduced into the wells 161 to 165. The inner parts of the respective regions of the puncture part 14, the flow paths 151 to 155, and the wells 161 to 165 in the microchip A have a negative pressure with respect to an atmospheric pressure. Thus, when the channel 4 is held in a state of the pointed part of the channel 4 having reached the inner space of the puncture part 14 for a certain time, the sample liquid is sucked by negative pressure and smoothly introduced into each region in a short time. Further, when a vacuum is formed in the inner parts of the respective regions, no air is present in the inner parts of the respective regions, so that the introduction of the sample liquid is not obstructed by an air and no air bubble occurs.

After the introduction of the sample liquid, as shown in FIG. 3B, the channel 4 is extracted, and the punctured part of the substrate layer $a_1$ is sealed. An arrow $F_2$ in FIG. 3B indicates a direction of extraction of the channel 4. At this time, when the substrate layer $a_1$ is formed of an elastic material such as PDMS or the like, the punctured part can be automatically sealed by resilience due to the elastic deformation of the substrate layer $a_1$ after the channel 4 is extracted. In the present disclosure, the automatic sealing of the punctured part due to the elastic deformation of the substrate layer will be defined as the "self-sealing property" of the substrate layer.

In order to ensure the self-sealing property of the substrate layer $a_1$, the thickness of the substrate layer from the surface of the substrate layer in the punctured part to the inner space of the puncture part 14 (see a reference d in FIG. 3B) needs to be set in an appropriate range according to the material of the substrate layer $a_1$ and the diameter of the channel 4. In addition, when the microchip A is heated at a time of analysis, the thickness d is set such that the self-sealing property is not lost due to an increase in internal pressure which increase is attendant on the heating.

In order to ensure the self-sealing due to elastic deformation of the substrate layer $a_1$, a channel having as small a diameter as possible is preferably used as the channel 4. Specifically, a painless needle whose point has an outside diameter of about 0.2 mm, which needle is used as a needle for insulin injection, is suitably used as the channel 4. In order to facilitate the injection of the sample liquid, a part obtained by cutting out the pointed part of a tip for a general-purpose micropipette may be connected to the base part of the painless needle. Thereby, when the painless needle is made to puncture the puncture part 14 with the pointed part of the tip filled with the sample liquid, the sample liquid within the pointed part of the tip connected to the painless needle can be sucked and injected into the inside of the puncture part 14 due to the negative pressure within the microchip A.

When a painless needle whose point has an outside diameter of 0.2 mm is used as the channel 4, the thickness d of the substrate layer $a_1$ formed by PDMS is ideally 0.5 mm or more or 0.7 mm or more when heating is performed.

As described above, in the microchip according to the present embodiment, when a sample liquid is introduced, the channel 4 is inserted into the positioning hole 13 provided in the arm 113 of the frame body 11 and made to puncture the main body 12, whereby the channel 4 can be made to puncture the puncture part 14 of the main body 12 accurately. The microchip according to the present embodiment can therefore allow the sample liquid to be introduced into even minute regions accurately and easily. In addition, the microchip according to the present embodiment can prevent an outside air from leaking into the regions and rendering the suction of the sample liquid by negative pressure impossible or faulty as a result of the channel 4 puncturing an inappropriate part of the main body 12. Further, the microchip according to the present embodiment can enhance the safety of operation by preventing the puncturing by mistake of a human body or the like with the channel 4.

In the present embodiment, description has been made of an example in which a total of five sets of five wells made to communicate with each other by one flow path, that is, a total of 25 wells are arranged in the microchip. However, the number and position of wells arranged in a microchip according to an embodiment of the present disclosure can be arbitrary, and the shape of the wells is not limited to the cylindrical shape shown in the figures. In addition, the configuration of the flow paths for sending the sample liquid injected into the puncture part 14 into each well is not limited to the mode shown in the figures. Further, the above description has been made of a case in which the substrate layer $a_1$ is formed of an elastic material and the channel 4 punctures the substrate layer $a_1$ from the surface of the substrate layer $a_1$. However, the channel 4 may puncture the substrate layer $a_2$ from the surface of the substrate layer $a_2$. In this case, it suffices to form the substrate layer $a_2$ of an elastic material, and impart a self-sealing property to the substrate layer $a_2$.

2. Example of Modification of Microchip According to First Embodiment

Figure 4A:
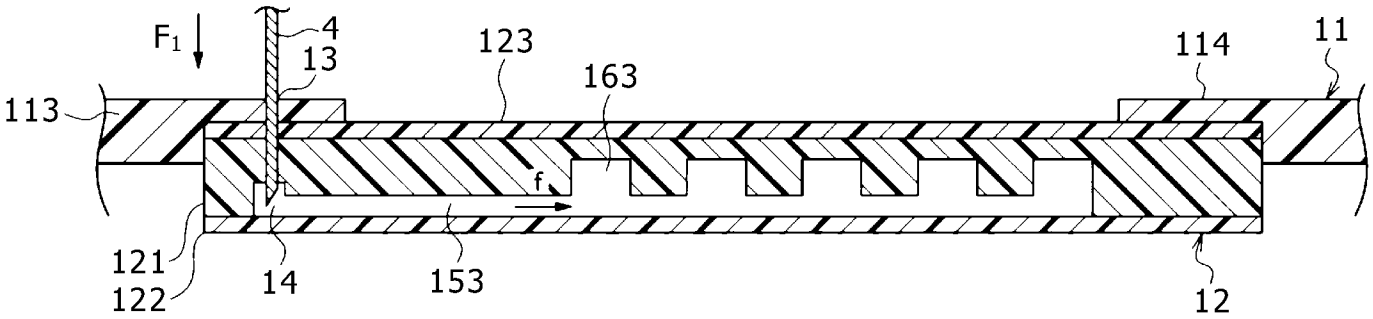
FIGS. 4A and 4B are schematic diagrams of assistance in explaining the constitution of an example of modification of the microchip and a method of introducing a sample liquid.
Figure 4B:
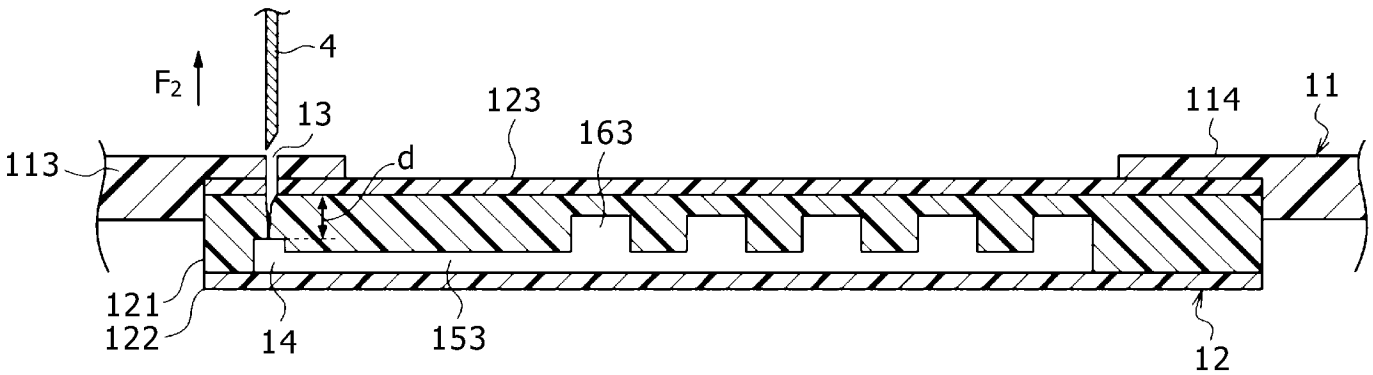

The constitution of an example of modification of the microchip A and a method of introducing a sample liquid are shown in FIGS. 4A and 4B.

A microchip according to this example of modification is different from the microchip A in that the microchip according to the example of modification is formed by laminating substrate layers $a_2$ and $a_3$ to a substrate layer $a_1$ in which a puncture part 14, flow paths 151 to 155, and wells 161 to 165 are formed, and is thus of a three-layer structure.

As in the microchip A, the substrate layer $a_1$ and the substrate layer $a_2$ are laminated to each other under a negative pressure with respect to an atmospheric pressure, and inside parts of the respective regions of the puncture part 14, the flow paths 151 to 155, and the wells 161 to 165 are hermetically sealed so as to be under a negative pressure. Further, it is more desirable to laminate the substrate layer $a_1$ and the substrate layer $a_2$ to each other under vacuum, and hermetically seal the inside parts of the respective regions so that the inside parts of the respective regions form a vacuum.

A material for the substrate layer $a_1$ is an elastic material having a self-sealing property, including a silicone base elastomer such as polydimethylsiloxane (PDMS) or the like as well as an acrylic base elastomer, a urethane base elastomer, a fluorine base elastomer, a styrene base elastomer, an epoxy base elastomer, natural rubber or the like.

These materials are flexible and capable of elastic deformation, whereas the materials have gas permeability. Thus, when a sample liquid introduced into the wells is heated, a substrate layer made of PDMS may allow the vaporized sample liquid to penetrate the substrate layer. Such disappearance of the sample liquid due to the vaporization of the sample liquid (liquid loss) decreases the accuracy of analysis, and also causes the mixing of new air bubbles into the wells.

In order to prevent this, the microchip according to the present example of modification has a three-layer structure formed by laminating the substrate layers $a_2$ and $a_3$ having gas impermeability to the substrate layer $a_1$ having a self-sealing property.

Glasses, plastics, metals, ceramics, and the like can be used as materials for the substrate layers $a_2$ and $a_3$. The plastics include PMMA (polymethyl methacrylate: an acrylic resin), PC (polycarbonate), PS (polystyrene), PP (polypropylene), PE (polyethylene), PET (polyethylene terephthalate), polydiethyleneglycol-bis-allylcarbonate, a SAN resin (styrene-acrylonitrile copolymer), an MS resin (MMA-styrene copolymer), TPX (poly(4-methylpentene-1)), polyolefin, an SiMA (siloxanyl methacrylate monomer)-MMA copolymer, an SiMA-fluorine containing monomer copolymer, a silicone macromer (A)-HFBuMA (heptafluorobutyl methacrylate)-MMA terpolymer, a disubstituted polyacetylene base polymer, and the like. The metals include aluminum, copper, stainless steel (SUS), silicon, titanium, tungsten, and the like. The ceramics include alumina ($Al_2O_3$), aluminum nitride (AlN), silicon carbide (SiC), titanium oxide ($TiO_2$), zirconium oxide ($ZrO_2$), quartz, and the like.

As shown in FIG. 4A, a sample liquid is introduced by making a channel 4 penetrate the substrate layer $a_1$ and injecting the sample liquid into the puncture part 14. An arrow $F_1$ in FIG. 4A indicates a direction of puncture of the channel 4. The puncture of the channel 4 is made such that the pointed part of the channel 4 pierces from the surface of the substrate layer $a_1$ through the substrate layer $a_1$ and reaches the inner space of the puncture part 14.

The channel 4 is inserted into a positioning hole 13 made in the arm 113 of a frame body 11 so as to be situated above the puncture part 14, and is made to puncture the substrate layer $a_1$, whereby the channel 4 is positioned with respect to the puncture part 14. In order for the channel 4 inserted into the positioning hole 13 to reach the surface of the substrate layer $a_1$ at this time, the substrate layer $a_3$ is also provided with a through hole at a position corresponding to the positioning hole 13.

3. Microchip According to Second Embodiment

Figure 5A:
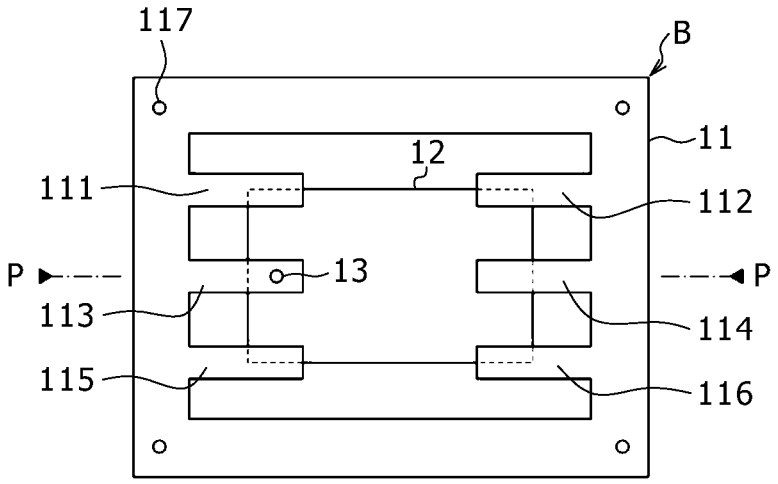
FIGS. 5A and 5B are schematic diagrams of assistance in explaining the constitution of a microchip according to a second embodiment of the present disclosure, FIG. 5A being a top view, and FIG. 5B being a sectional view corresponding to a section P-P of FIG. 5A.
Figure 5B:
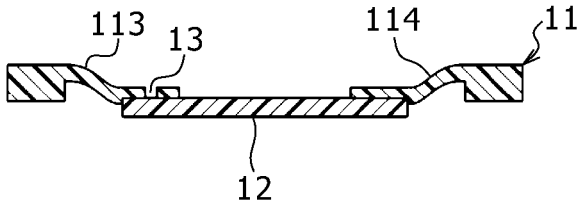

FIGS. 5A and 5B are schematic diagrams of a microchip according to a second embodiment of the present disclosure. FIG. 5A is a top view. FIG. 5B is a sectional view corresponding to a section P-P of FIG. 5A.

The microchip indicated by a reference B in FIG. 5A includes a main body 12 having a region disposed therein into which region a substance is introduced and in which region chemical analysis or biological analysis of the substance is performed and a frame body 11 for retaining the main body 12. The main body 12 of the microchip B is identical to the main body 12 of the microchip A or the example of modification of the microchip A described above, and therefore description thereof will be omitted in the following.

The frame body 11 retains the main body 12 by arms 111, 112, 113, 114, 115, and 116 extended toward a center. Each of these arms is in contact with the upper surface of the main body 12, and retains the main body 12 from above. The main body 12 and the frame body 11 may be bonded to each other by adhesion at the surfaces of the main body 12 and the frame body 11 which surfaces are in contact with each other, or may be bonded to each other by being formed integrally with each other.

Figure 6:
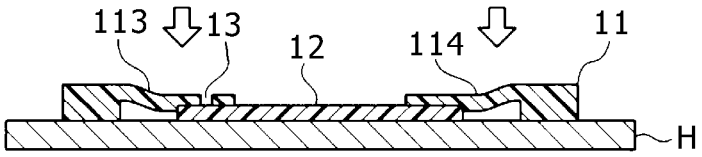
FIG. 6 is a schematic sectional view of assistance in explaining a state of the microchip according to the second embodiment being mounted on a mounting surface.

Each of the arms of the microchip B has flexibility, and has a function of retaining the main body 12 by biasing the main body 12 against a mounting surface on which the microchip B is mounted on the basis of the flexibility. FIG. 6 shows the microchip B in a state of being mounted on the mounting surface. Block arrows in FIG. 6 indicate a direction of biasing the main body 12 by each arm.

A reference H in FIG. 6 denotes the mounting surface on which the microchip B is mounted. When a substance introduced into the region disposed in the microchip B is analyzed optically, for example, the mounting surface H may be the surface of an optical member such as a surface light source, a surface lens, a surface filter, or the like. When the microchip B is heated at a time of analysis, for example, the mounting surface H may be the surface of a temperature controlling member such as a surface heater or the like.

As shown in FIG. 5B, each arm retains the main body 12 by being disposed so as to project from the frame body 11 in an oblique direction. Thereby, the surface of the main body 12 which surface is in contact with the mounting surface in a state of being retained by the frame body 11 is projecting to the side of the mounting surface more than the surface of the frame body 11 which surface is in contact with the mounting surface. Thus, as shown in FIG. 6, in a state in which the microchip B is mounted on the mounting surface H and the main body 12 and the frame body 11 are brought into contact with the mounting surface H, each arm presses the main body 12 against the mounting surface H on the basis of the flexibility of each arm, and thereby the main body 12 and the mounting surface H are in close contact with each other. Incidentally, in order to mount the microchip B at a predetermined position on the mounting surface H accurately at this time, positioning pins may be provided on the side of the mounting surface H, and fitting holes for the pins (see a reference 117 in FIG. 5A) may be provided on the side of the frame body 11.

When the main body 12 is retained in close contact with the mounting surface H by being biased against the mounting surface H, heat transfer efficiency is increased, and high-precision temperature control is made possible, in the case where the mounting surface H is the surface of a temperature controlling member. In addition, when the mounting surface H is the surface of an optical member, the irradiation of the inside of the region disposed in the main body 12 with light or the detection of light originating from the inside of the region can be performed efficiently.

It suffices for at least one or more of the arms 111, 112, 113, 114, 115, and 116 to have flexibility. Leaf springs formed by various kinds of plastic having elasticity, for example, can be used as arms having flexibility. In addition, as means for retaining the main body 12 in close contact with the mounting surface H by biasing the main body 12 against the mounting surface H, a member exhibiting elastic deformation (a spring or a shock absorbing rubber) may be placed between the main body 12 and the frame body 11 retaining the main body 12 in place of arms having flexibility. The member exhibiting elastic deformation may be separate from the main body 12 or the frame body 11, or may be formed integrally with the main body 12 or the frame body 11.

A reference numeral 13 in FIGS. 5A and 5B denotes a positioning hole functioning, when a sample liquid is externally injected into the region disposed in the main body 12, to position a channel for injecting the sample liquid in the puncture part 14 of the main body 12. As in the microchip A, the positioning hole 13 is made in the arm 113 extended on the main body 12. The sample liquid can be introduced into the microchip B by a similar method to that of the microchip A.

4. Microchip According to Third Embodiment

Figure 7A:
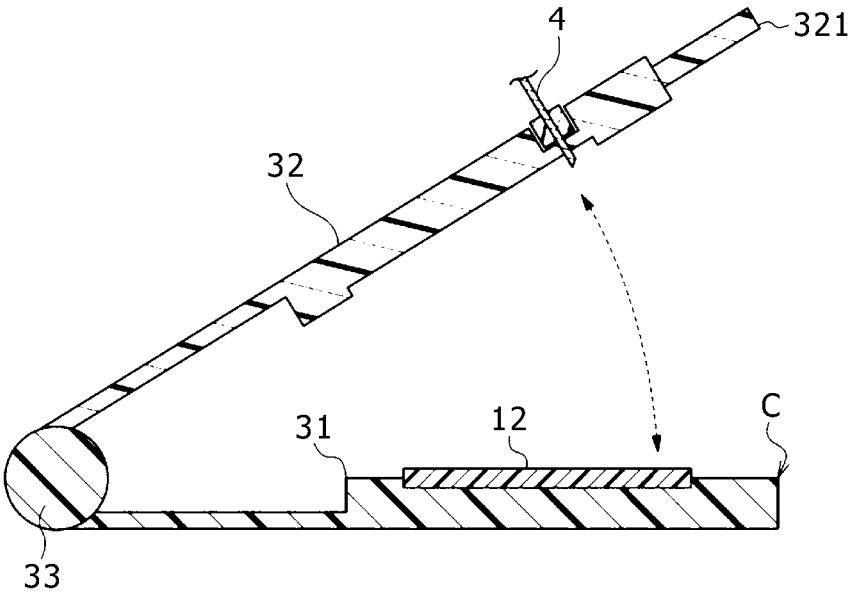
FIGS. 7A and 7B are schematic diagrams of assistance in explaining the constitution of a microchip according to a third embodiment of the present disclosure and a method of introducing a sample liquid.
Figure 7B:
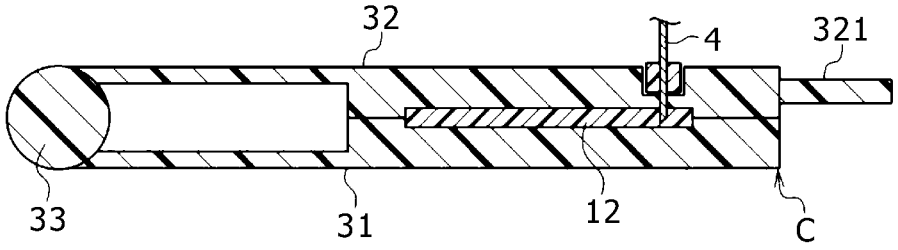

The constitution of a microchip according to a third embodiment of the present disclosure and a method of introducing a sample liquid are shown in FIGS. 7A and 7B.

The microchip indicated by a reference C in FIGS. 7A and 7B includes a main body 12 having a region disposed therein into which region a substance is introduced and in which region chemical analysis or biological analysis of the substance is performed. The main body 12 of the microchip C is identical to the main body 12 of the microchip A or the example of modification of the microchip A described above, and therefore description thereof will be omitted in the following. In addition to the main body 12, the microchip C includes a first member indicated by a reference 31 in FIGS. 7A and 7B and a second member indicated by a reference 32 in FIGS. 7A and 7B.

The main body 12 is mounted and retained on the upper surface of the first member 31. In order to mount the main body 12 at a predetermined position on the upper surface of the first member 31 accurately at this time, positioning pins may be provided on the side of the first member 31, and fitting holes for the pins may be provided on the side of the main body 12. Alternatively, a system of butting the main body 12 against a predetermined position of the upper surface of the first member 31 using the external shape of the main body 12 may be adopted.

In addition, the second member 32 retains a channel 4 for externally injecting a sample liquid into the region disposed in the main body 12 such that the channel 4 is faced toward the main body 12 retained by the first member 31. One end of the first member 31 and one end of the second member 32 are coupled to each other by a hinge 33, and the first member 31 and the second member 32 are capable of closing and opening operations with the hinge 33 as a pivot (see a dotted line arrow in FIG. 7A). The position at which the main body 12 is retained in the first member 31 and the position at which the channel 4 is retained in the second member 32 are configured such that the channel 4 is positioned in the puncture part 14 of the main body 12 (see FIG. 3A) in a state of the hinge 33 being closed (see FIG. 7B).

A material for the first member 31 and the second member 32 may be glass, various kinds of metal, or various kinds of plastic. The main body 12 and the first member 31 or the second member 32 may be members separate from each other, or may be members formed integrally with each other.

In place of the hinge 33, a rotary dumper may be used as means for coupling the first member 31 and the second member 32 to each other such that the first member 31 and the second member 32 can be opened and closed. The use of the rotary dumper stabilizes the opening and closing operations of the first member 31 and the second member 32. In addition, a spring exhibiting elasticity in an opening direction and a closing direction may be connected between the first member 31 and the second member 32, one end of the first member 31 and one end of the second member 32 being coupled to each other by the hinge 33, or a stopper mechanism for limiting the opening and closing operation within a predetermined range may be provided. The spring and the stopper mechanism can also stabilize the opening and closing operations of the first member 31 and the second member 32, and improve operability. Incidentally, a reference 321 in FIGS. 7A and 7B indicates a handle held when the second member 32 is opened or closed with respect to the first member 31.

In the microchip according to the present embodiment, when a sample liquid is introduced, the hinge 33 is closed with the main body 12 retained in the first member 31 and with the channel 4 retained in the second member 32, whereby the channel 4 can be made to puncture the puncture part 14 of the main body 12 accurately. The microchip according to the present embodiment can therefore allow the sample liquid to be introduced into even minute regions accurately and easily. In addition, the microchip according to the present embodiment can prevent an outside air from leaking into the regions and rendering the suction of the sample liquid by negative pressure impossible or faulty as a result of the channel 4 puncturing an inappropriate part of the main body 12. Further, the microchip according to the present embodiment can enhance the safety of operation by preventing the puncturing by mistake of a human body or the like with the channel 4.

5. Microchip According to Fourth Embodiment

Figure 8:
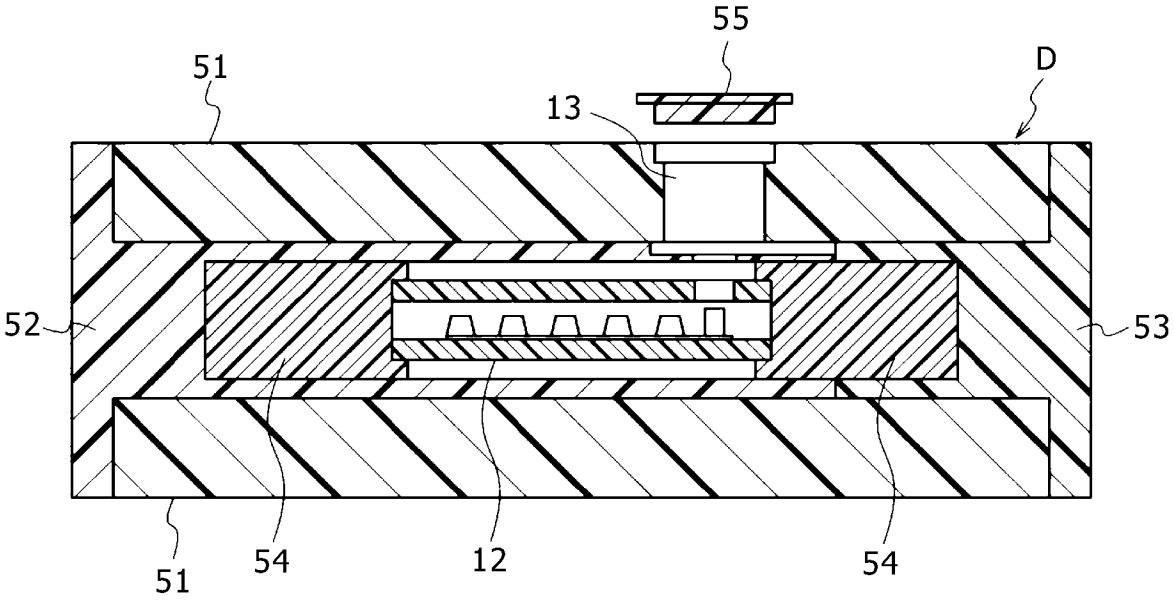
FIG. 8 is a schematic sectional view of assistance in explaining a microchip equipped with a container according to a fourth embodiment of the present disclosure.

FIG. 8 shows the constitution of a microchip according to a fourth embodiment of the present disclosure.

The main body 12 of the microchip equipped with a container which microchip is indicated by a reference D in FIG. 8 is identical to the main body 12 of the example of modification of the microchip A described above, and therefore description thereof will be omitted in the following. The microchip D equipped with a container includes a container for housing the main body 12 within the container in addition to the main body 12 as a microchip.

The container includes a cassette 51 and inserts 52 and 53 forming the casing of the container and a rib 54 for retaining the main body 12 in midair within the container. The inserts 52 and 53 are detachably inserted into the cassette 51. In addition, the rib 54 detachably retains the main body 12, and the rib 54 itself is detachably retained by the inserts 52 and 53. The rib 54 retains the main body 12 in midair within the container, and thereby prevents a shock from the outside of the container from being inflicted on the main body 12 and prevents the main body 12 from being damaged during storage of the microchip or during transportation of the microchip.

A positioning hole 13 for inserting the channel 4 into the puncture part 14 (see FIGS. 4A and 4B) of the housed main body 12 is made in the cassette 51. A reference 55 in FIG. 8 indicates a lid for the positioning hole 13 which lid is removed at a time of use.

A material for the cassette 51 and the inserts 52 and 53 can be glass or various kinds of plastic (polypropylene, polycarbonate, cycloolefin polymers, and polydimethylsiloxane). The cassette 51 is preferably formed by using a transparent material to secure visibility of the main body 12 from the outside of the container. In addition, a material for the rib 54 can also be glass or various kinds of plastic. However, the rib 54 is preferably formed by using an elastic material to alleviate a shock from the outside.

The container is sealed under a reduced pressure by a packing material not shown in FIG. 8. As described above, the substrate layers of the microchip according to one embodiment of the present disclosure are laminated to each other under a negative pressure with respect to an atmospheric pressure. Thereby the inside parts of respective regions formed in the microchip are hermetically sealed so as to be under a negative pressure with respect to the atmospheric pressure (or a vacuum). However, when the microchip is stored or transported for a long period of time, the negative pressure or vacuum state within the regions may disappear due to a small amount of air penetrating the substrate layers. The sealing of the microchip under a reduced pressure by a packing material can prevent such a disappearance of the negative pressure or vacuum state within the regions during a period of storage or a period of transportation. It suffices to use, as the packing material, a publicly known material in the past such as a synthetic resin film capable of a heat seal, an aluminum film having an excellent gas barrier property, or the like.

A method of introducing a sample liquid in the microchip D equipped with the container will next be described with reference to FIGS. 9 to 11.

A sample liquid can be introduced in the microchip D equipped with the container by inserting the channel 4 into the positioning hole 13 made in the cassette 51 and making the channel 4 penetrate the substrate layer of the main body 12. The positioning hole 13 is provided at a position corresponding to the puncture part 14 of the housed main body 12. Thus, the channel 4 made to penetrate the substrate layer from the positioning hole 13 is made to puncture the substrate layer of the main body 12 so that the pointed part of the channel 4 reaches the inner space of the puncture part 14.

In the present embodiment, description will be made of an example in which a sample liquid is introduced by using a sample tube 41 housing the sample liquid and a cylindrical adapter 42 for connecting the sample tube 41 and the channel 4 to each other so as to supply the sample liquid within the sample tube 41 to the channel 4. A threaded surface is formed as the inner circumferential surface of the adapter 42. The channel 4 is screwed into the threaded surface and retained inside the adapter 42.

Figure 9:
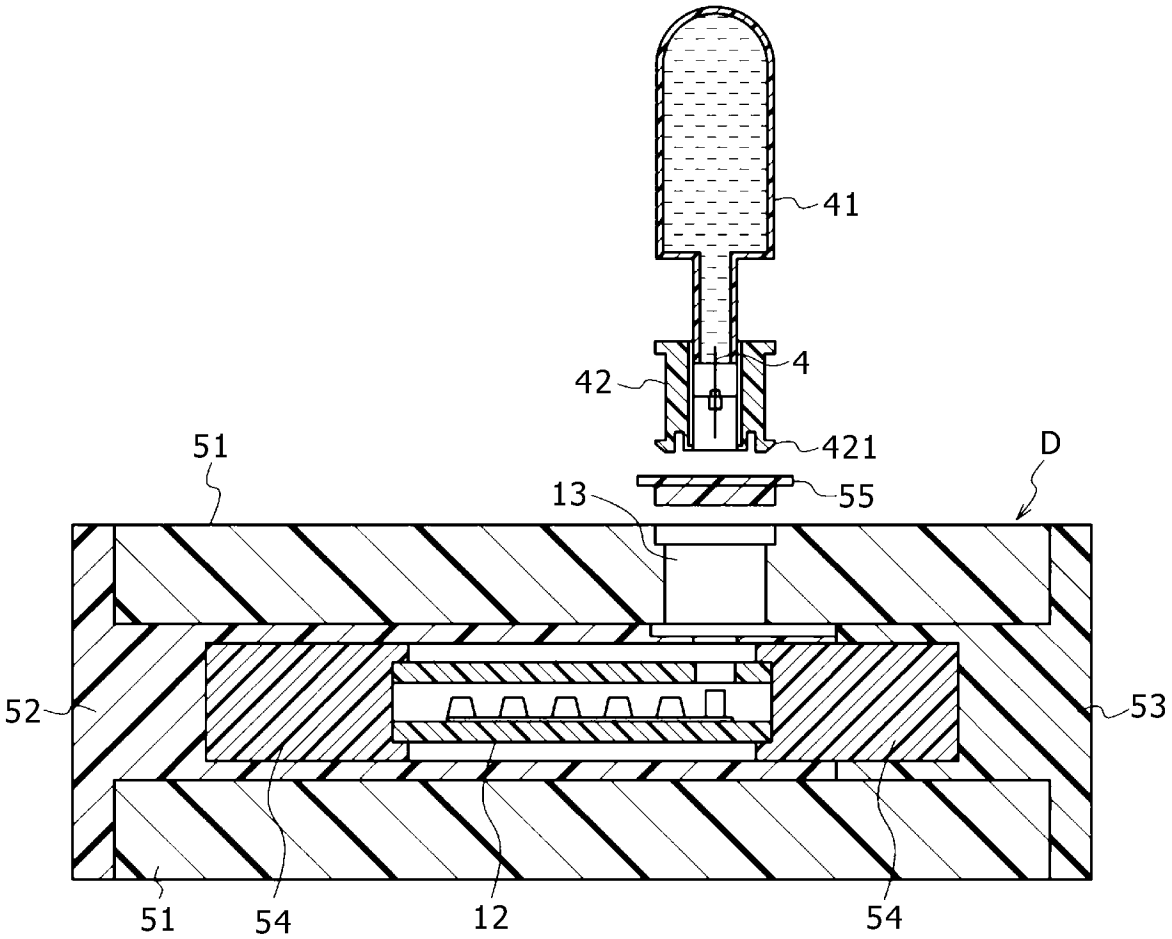
FIG. 9 is a schematic sectional view of assistance in explaining a method of introducing a sample liquid in the microchip equipped with the container according to the fourth embodiment.

First, as shown in FIG. 9, the sample tube 41 filled with the sample liquid is connected to the adapter 42 retaining the channel 4. The sample tube 41 can be connected by screwing the connecting mouth of the sample tube 41 into the threaded surface formed as the inner circumferential surface of the adapter 42. In this state, the pointed part of the channel 4 is housed within the adapter 42, and is not exposed to the outside.

Figure 10:
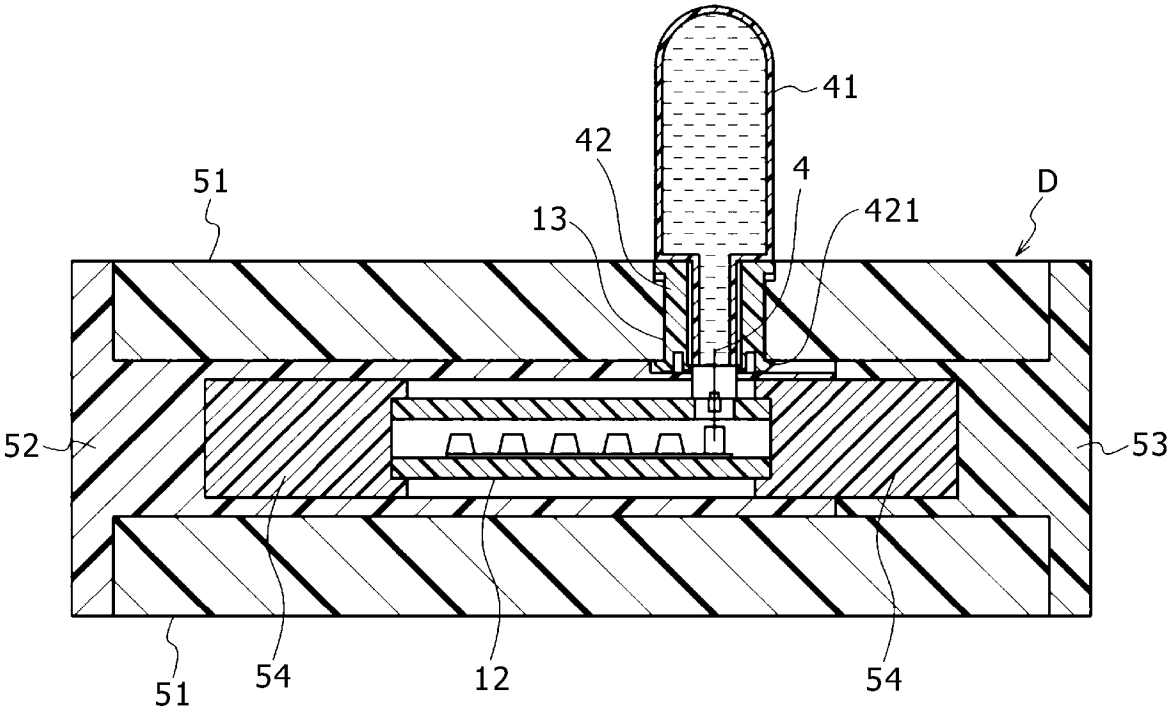
FIG. 10 is a schematic sectional view of assistance in explaining the method of introducing the sample liquid in the microchip equipped with the container according to the fourth embodiment.
Figure 11:
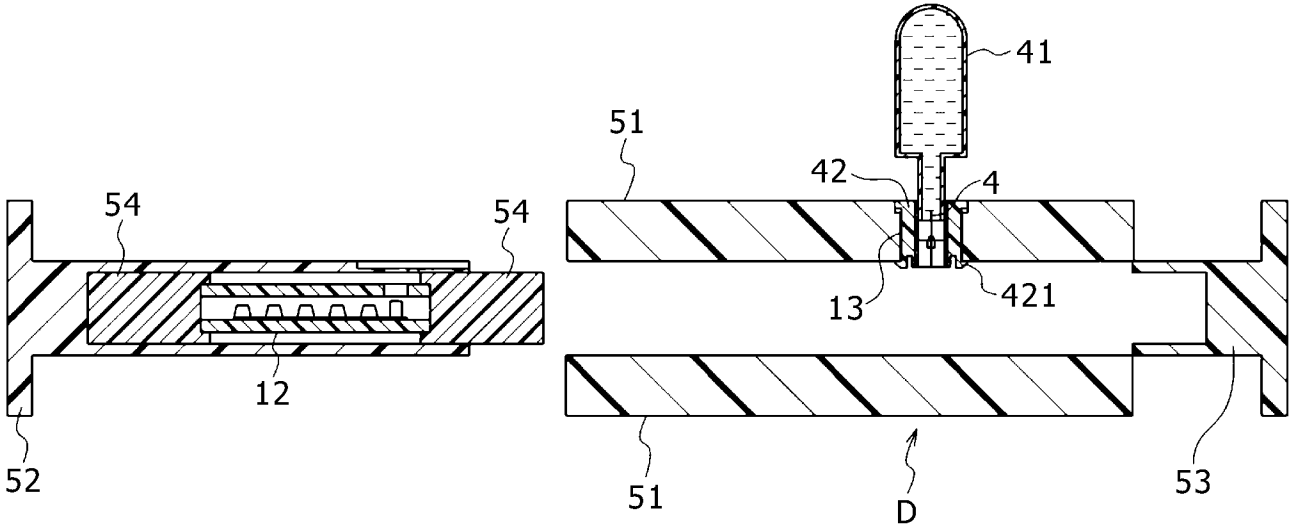
FIG. 11 is a schematic sectional view of assistance in explaining the method of introducing the sample liquid in the microchip equipped with the container according to the fourth embodiment.

The microchip D equipped with the container sealed under a reduced pressure by the packing material not shown in the figure is extracted after the packing material is opened, the lid 55 is removed, and the adapter 42 connected with the sample tube 41 is inserted into the positioning hole 13 made in the cassette 51 (see FIG. 10). When the connecting mouth of the sample tube 41 is further screwed into the adapter 42 with the adapter 42 fitted in the positioning hole 13, the channel 4 is screwed in simultaneously. When the connecting mouth of the sample tube 41 is further screwed in, the channel 4 is pushed out, and the pointed part of the channel 4 is exposed from the inside of the adapter 42. The exposed pointed part of the channel 4 punctures the puncture part 14 of the main body 12 which puncture part 14 is disposed at a position corresponding to the positioning hole 13, and reaches the inner space of the puncture part 14. When a state of the pointed part of the channel 4 having reached the inner space of the puncture part 14 is maintained for a certain time, the sample liquid within the sample tube 41 is sucked by negative pressure, and introduced into each region.

When the adapter 42 is fitted into the positioning hole 13, a fringe 421 provided on the outer circumferential surface of the adapter 42 is engaged with the inside surface of the cassette 51. Thereby, the adapter 42 cannot be removed easily after being once fitted into the positioning hole 13.

When the connecting mouth of the sample tube 41 is drawn out from the inside of the adapter 42 by being screwed upward after completion of the introduction of the sample liquid, the channel 4 is also screwed upward simultaneously. When the connecting mouth of the sample tube 41 is screwed upward by a predetermined amount, the pointed part of the channel 4 is housed within the adapter 42 again, and is not exposed to the outside (see FIG. 11).

Next, the container housing the main body 12 is disassembled to extract the main body 12. The container is disassembled by extracting the inserts 52 and 53 from the cassette 51. At this time, the main body 12 retained by the rib 54 is desirably extracted together with one of the insert 52 and the insert 53. Incidentally, one of the insert 52 and the insert 53 may be formed integrally with the cassette 51. In this case, the other insert is formed so as to be able to be removed together with the rib 54 and the main body 12. It suffices to remove the rib 54 from the main body 12 before using the main body 12 for analysis.

As described above, in the microchip equipped with the container according to the present embodiment, when a sample liquid is introduced, the channel 4 is inserted into the positioning hole 13 provided in the cassette 51 and made to puncture the main body 12, whereby the channel 4 can be made to puncture the puncture part 14 of the main body 12 accurately. The microchip equipped with the container according to the present embodiment can therefore allow the sample liquid to be introduced into even minute regions of the microchip accurately and easily. In addition, the microchip according to the present embodiment can prevent an outside air from leaking into the regions and rendering the suction of the sample liquid by negative pressure impossible or faulty as a result of the channel 4 puncturing an inappropriate part of the main body 12. Further, after the sample liquid is introduced, the pointed part of the channel 4 is housed within the adapter 42 and is not exposed to the outside, and the adapter 42 itself cannot be removed easily after being once fitted into the positioning hole 13. Thus, there is no fear of puncturing a human body or the like with the channel 4 by mistake at a time of disposal, and there is no fear of the sample liquid being diffused and contaminating an environment.

6. Example of Modification of Microchip According to Fourth Embodiment

Figure 12:
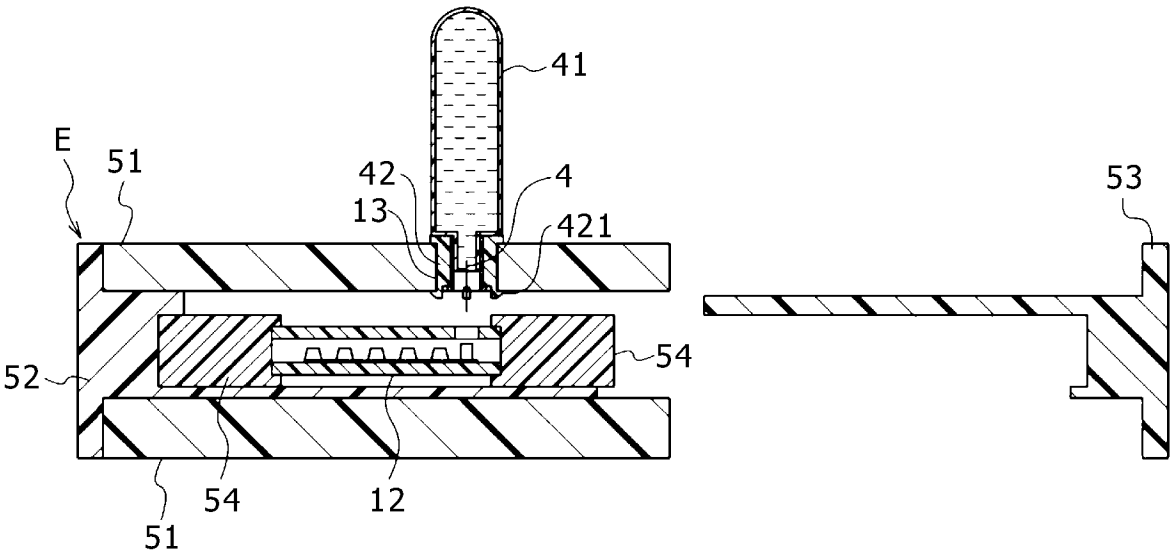
FIG. 12 is a schematic diagram of assistance in explaining the constitution of an example of modification of the microchip equipped with the container according to the fourth embodiment and a method of introducing a sample liquid.
Figure 13:
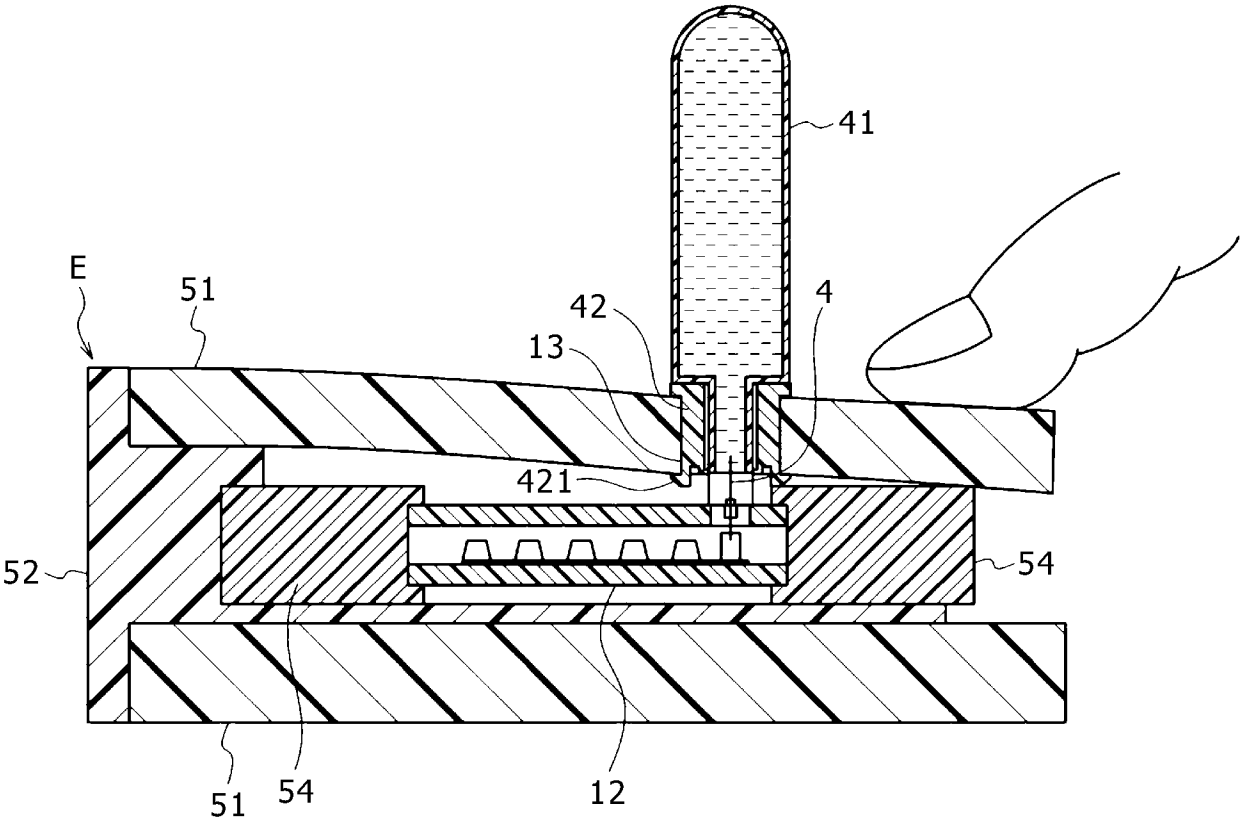
FIG. 13 is a schematic diagram of assistance in explaining the method of introducing the sample liquid into the example of modification of the microchip equipped with the container according to the fourth embodiment.

The constitution of an example of modification of the microchip D equipped with the container and a method of introducing a sample liquid are shown in FIGS. 12 and 13.

A microchip equipped with a container according to this example of modification is different from the microchip D equipped with the container in the shape of inserts 52 and 53 forming the container. Specifically, the microchip E equipped with the container according to the present example of modification is formed such that when an insert 53 is extracted from a cassette 51, an air gap due to the extracted insert 53 is formed between the inside surface of a part of the cassette 51 in which part a positioning hole 13 is made and the surface of a main body 12 retained in midair within the container by a rib 54.

In a procedure for introducing a sample liquid in the present example of modification, first, an adapter 42 connected with a sample tube 41 is inserted into the positioning hole 13 made in the cassette 51. Then, the insert 53 is extracted to form an air gap between the cassette 51 and the main body 12. Next, when the connecting mouth of the sample tube 41 is further screwed into the adapter 42 with the adapter 42 fitted in the positioning hole 13, a channel 4 is pushed out, and the pointed part of the channel 4 is exposed from the inside of the adapter 42 to the air gap.

When the surface of the cassette 51 on a side where the insert 53 was inserted is pressed by a finger or the like in this state, as shown in FIG. 13, the cassette 51 is bent downward, and the pointed part of the channel 4 is made to puncture the puncture part 14 of the main body 12 which puncture part 14 is disposed at a position corresponding to the positioning hole 13. When the pressing of the surface of the cassette 51 is continued to maintain a state of the pointed part of the channel 4 having reached the inner space of the puncture part 14 for a certain time, the sample liquid within the sample tube 41 is sucked by negative pressure, and introduced into each region.

A microchip according to an embodiment of the present disclosure can introduce a sample into a region easily and accurately, and make it possible to obtain high analysis accuracy. Thus, a microchip and the like according to an embodiment of the present disclosure can be suitably used in an electrophoresis device that separates a plurality of substances from each other in a flow path on the microchip by electrophoresis and which optically detects each of the separated substances, a reaction device (for example a real-time PCR device) that allows reaction between a plurality of substances to progress within a well on the microchip and which optically detects a resulting substance, and the like.

It should be understood that various changes and modifications to the presently preferred embodiments described herein will be apparent to those skilled in the art. Such changes and modifications can be made without departing from the spirit and scope and without diminishing its intended advantages. It is therefore intended that such changes and modifications be covered by the appended claims.

The application is claimed as follows:

1. A microchip comprising:

a main body that comprises a first substrate layer laminated to a second substrate layer, and an airtight region between the laminated first and second substrate layers, wherein the airtight region has a pressure lower than an atmospheric pressure; and a frame body mounted to the main body, wherein the frame body comprises an arm, wherein the first substrate layer of the main body includes a sealing portion that extends from an outer surface of the first substrate layer to a puncture part in the airtight region, wherein the first substrate layer is configured to have a self-sealing characteristic due to elastic deformation, and wherein the arm of the frame body includes a positioning hole, wherein the positioning hole is configured for alignment above the puncture part in the airtight region, and wherein the positioning hole is smaller than the area of the airtight region.

2. The microchip according to claim 1, wherein the frame body includes a plurality of arms, wherein each arm of the plurality of arms contacts one of an upper surface or a lower surface of the main body.

3. The microchip according to claim 2, wherein the opening is in one of the plurality of arms, and wherein the plurality of arms are biased against the upper surface and the lower surface of the main body to support the main body between the plurality of arms.

4. The microchip according to claim 1, wherein the airtight region in the main body includes at least one elongated flow path that extends away from the puncture part, and at least one well positioned along a length of the at least one elongated flow path.

5. The microchip according to claim 1, wherein the airtight region in the main body includes a plurality of flow paths that extends away from the puncture part.

6. The microchip according to claim 1, wherein the first substrate layer is of a material selected from a silicone base elastomer, an acrylic base elastomer, a urethane base elastomer, a fluorine base elastomer, a styrene base elastomer, an epoxy base elastomer or a natural rubber.

7. The microchip according to claim 1, wherein the first substrate layer and the second substrate layer are of materials that are optically transparent and auto fluorescent.

8. The microchip according to claim 1, wherein the pressure of the airtight region is about 1/100 of the atmospheric pressure.

* * * * *